US005133369A

United States Patent [19]

Billings

[11] Patent Number: 5,133,369

[45] Date of Patent: Jul. 28, 1992

[54] METHOD OF APPLYING NAIL ART TO FINGERNAILS

[76] Inventor: Calvert W. Billings, 23221 Peralta, Suite H, Laguna Hills, Calif. 92653

[21] Appl. No.: 806,359

[22] Filed: Dec. 13, 1991

[51] Int. Cl.[5] ..... A45D 24/00

[52] U.S. Cl. ..... 132/200; 132/73

[58] Field of Search ..... 132/200, 73, 333, 285

[56] References Cited

U.S. PATENT DOCUMENTS

| | | | |
|---|---|---|---|
| 1,889,484 | 11/1932 | Marschburn | 132/73 X |
| 3,598,685 | 8/1971 | Lee et al. | 132/73 X |
| 4,476,883 | 10/1984 | Diaz | 132/73 |
| 4,944,318 | 7/1990 | Gaylord, Jr. et al. | 132/73 |

*Primary Examiner*—John J. Wilson
*Assistant Examiner*—Jeffrey A. Smith
*Attorney, Agent, or Firm*—Francis X. LoJacono

[57] ABSTRACT

The present invention provides a method of applying nail polish in an artistic manner to a fingernail which includes using a liquid medium that is adapted to support a given amount of nail polish. The nail polish is freely suspended on the surface of the liquid medium, whereby the nail polish is artistically arranged to create and define a desired design configuration. The artistic configuration of the nail polish is readily formed by arranging or rearranging a drop or a plurality of drops of the nail polish while supported on the liquid medium. A suitable implement such as a toothpick or the like is lightly touched to the surface of the nail polish so as to move the suspended nail polish into a configuration that will provide the desired results for the transfer of the nail polish as designed to the surface of a fingernail. These steps are repeated for each of the fingernails.

14 Claims, 1 Drawing Sheet

METHOD OF APPLYING NAIL ART TO FINGERNAILS

BACKGROUND OF THE INVENTION

1. Field of the Invention

The present invention relates generally to a method of applying fingernail polish to one's fingernails, and more particularly the method of applying various artistic designs to fingernails.

2. Description of the Prior Art

As is well known in the art, various problems and difficulties are encountered in providing a suitable means for applying nail art designs to fingernails. At present it is very difficult to apply design configurations on fingernails and more particularly to apply a given design configuration that can be more accurately reproduced on each the nails of all ten fingers.

The method presently used consist of airbrushing a design over a polished nail or free-hand painting each nail with a design. Free-hand painting requires a skilled worker with some artistic ability to apply the artwork to each nail. This method takes considerable time and can be costly. There is no suitable way at this time for an individual herself to satisfactorily apply even a very simple design without help. It is possible, however, for one to apply false fingernails that have been provided with some type of artwork prior to mounting the false nail to the actual fingernail. Using the false-nail method does not allow for frequent changing of designs to match an outfit as may be desired.

OBJECTS AND ADVANTAGES OF THE INVENTION

It is an object of the present invention to provide a method of applying various artistic designs to fingernails using a suitable medium on which to paint a desired design wherein the configuration of the selected design can be simply and readily produced.

Another object of the invention is to provide a method of applying various artistic designs to fingernails wherein the individual can apply the design by herself as desired.

Still another object of the present invention is to provide a method wherein the forming of the design can be simply accomplished by placing a small drop or drops of nail polish on the surface of a suitable liquid medium, and then elaborate the design configuration with an object or implement deemed suitable to provide the desired effect. Various objects or implements can be used such as an orangewood stick, toothpick, hair pick or cuticle pusher.

A further object of the invention is to provide a method of this type that allows the transfer of the created design suspended on the liquid medium by simply pressing the surface of the nail slightly against the finished nail-polish design. This allows the design to adhere to the surface of the nail. Once the design polish dries on the nail a protective top coating is applied. Thus it can be readily understood that this simple method can be accomplished by oneself and the design can be readily changed as desired.

SUMMARY OF THE INVENTION

The method of the present invention consists of applying nail art to fingernails using a liquid medium that allows a given amount of nail polish to be suspended on the surface of the liquid whereby the suspended polish can be artistically decorated to create a desired design. The artistic design of the polish is readily formed by means of a suitable implement such as a toothpick that lightly touches the polish so as to moved the polish into a configuration that will create the desired design for transfer to the surface of one's fingernail. These steps are repeated for each of the fingernails.

The various features of novelty which characterize the invention are pointed out with particularity in the claims annexed to and forming a part of this disclosure. For a better understanding of the invention, its operating advantages by its use, reference should be had to the accompanying drawings and descriptive matter in which there are illustrated and described the preferred embodiments of the invention.

BRIEF DESCRIPTION OF THE DRAWINGS

Novel features and advantages of the present invention, in addition to those mentioned above, will become apparent to those skilled in the art from reading the following detailed description in conjunction with the accompanying drawings wherein.

DETAILED DESCRIPTION OF THE INVENTION

Figure 1:
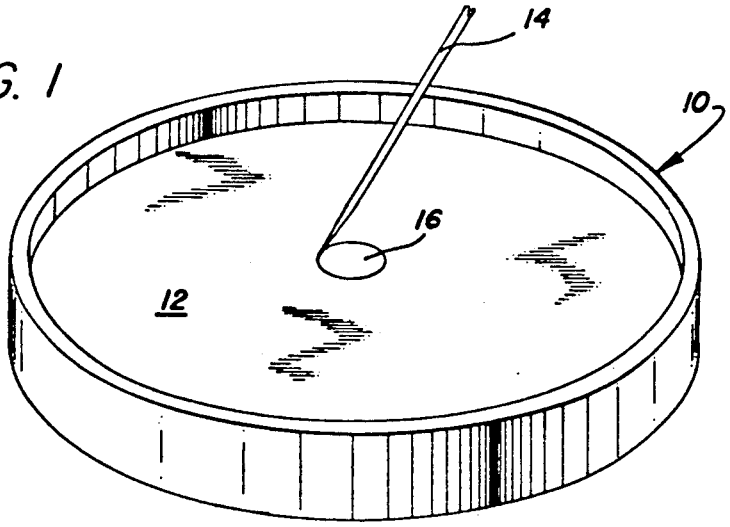
FIG. 1 is a pictorial view showing a small drop of nail polish suspended on the surface of a liquid transfer medium and wherein an implement used for arranging a design configuration of the nail polish is touching the edge of the polish.

Referring more particularly to FIG. 1, there is shown a receptacle, generally indicated at 10, in which a suitable liquid medium 12 is disposed. The medium is preferably a somewhat thickened liquid or any other suitable liquid that provides a surface tension to support the weight of a small drop of nail polish 16 when placed thereon, as illustrated in FIG. 1.

Accordingly, the present invention comprises a simple but unique method of applying nail art to one's fingernail using a medium that supports one or more drops of nail polish, yet allows the polish to be removed or transferred therefrom without the polish being molecularly attached to the medium or intermingled therewith. That is, the chemical substance of the nail polish is not compatible with the chemical substance of the liquid medium which has a thixotropic consistency. The preferred liquid medium consists of ingredients that include: purified water, hydroxypropylethylcellulose, starch, glyceryl stearate, cellulose acetate, propylparaben, quaternium-15, and any suitable FD&C coloring such as FD&C Red No. 40.

The preferred method of applying nail air to one's fingernails consist of the steps of applying a base coat of a clear or colored nail polish over the fingernail and allowing this base coat to dry. The preferred transfer medium 12, as described above, is placed in a suitable shallow container or receptacle. The user then selects one or more nail polishes of different colors.

Figure 2:
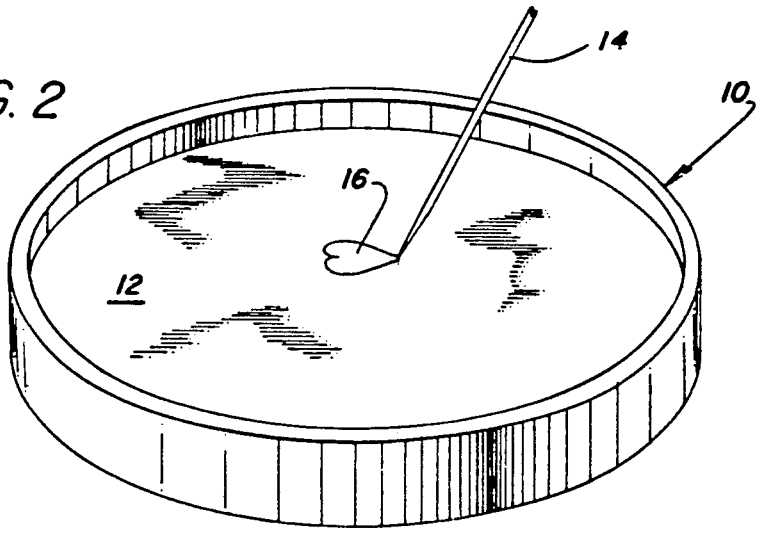
FIG. 2 is a pictorial view similar to that shown in FIG. 1, wherein the implement has been moved through the surface of the polish, causing a new configuration of the drop to be formed.
Figure 3:
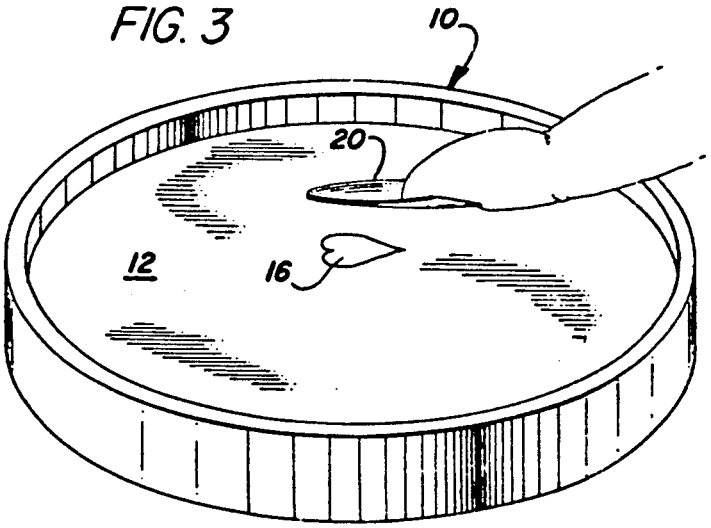
FIG. 3 is a pictorial view similar to that shown in FIG. 2, wherein the fingernail of the finger is being lightly pressed against the newly formed design of the suspended polish.
Figure 4:
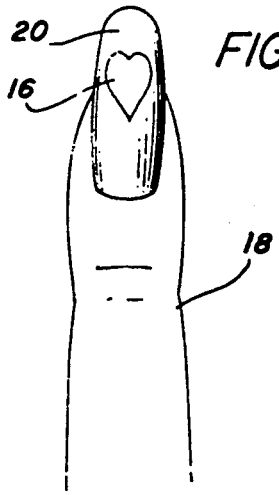
FIG. 4 is a front-elevational view of a fingernail after the designed drop of polish has been transferred from the surface of the liquid transfer medium to the surface of the nail.

If more than one nail polish colors are to be used in creating the design, they can be either individually used or mixed prior to placing the polish on the surface of medium 12. Accordingly, a given amount of the selected polish is placed on the surface of the liquid medium so as to be suspended thereon. The next step is to artistically arrange the nail polish so as to create a particular artistic design while the polish is suspended on the surface of the liquid and is still wet. The rearranging of the configuration of the polish is readily accomplished by various suitable implements such as a toothpick 14 illustrated in FIGS. 1 and 2. Other implements can also be used such as previously described above. In FIG. 1 toothpick 14 is shown positioned on the outer edge of the drop of nail polish 16. To form a simple design such as a heart as shown in FIGS. 2, 3 and 4, one lightly touches drop 16 and then simply pulls or gently moves the tip of the toothpick through and across the polish as indicated in FIG. 3.

It should be mentioned at this time that, instead of a drop of polish as shown, several lines can be drawn on the medium surface or several colored dots may be placed in various arrangements with or without the use of an implement. However, once the design is arranged, the individual's finger 18 together with fingernail 20 is positioned so that the fingernail can be lightly pressed against the surface of designed polish 16. This step allows polish 16 as designed to transfer to the surface of fingernail 20 (See FIG. 3.) FIG. 4 shows the heart design after it has been transferred to fingernail 20. These steps are repeated for each of the fingernails on the individual's hand.

After the designed nail polish dries any excess of the liquid medium remaining on the finger is readily removed by using warm or cool water. Then a protective top coat of clear polish is used to both protect the polished nail and to provide a shine.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What I claim is:

1. A method of creating and applying nail art design to fingernails comprising the steps of:

filling a container with a nail polish transfer medium;

placing at least one drop of nail polish on the surface of said transfer medium whereby said nail polish is suspended on said surface thereof;

arranging the suspended nail polish so as to create an artistically desired design;

transferring said nail polish as designed from said surface of said medium to the surface of a fingernail;

allowing said nail polish as designed to dry.

2. The method as recited in claim 1 including the step of applying a protective clear top coat over said fingernail and said designed nail polish.

3. The method as recited in claim 2, wherein said transfer medium is a liquid having a surface for supporting said nail polish positioned thereon.

4. The method as recited in claim 3, wherein a plurality of drops of nail polish are arranged as a design configuration which are selectively positioned on said surface of said medium.

5. The method as recited in claim 4, including the step of providing a means for arranging the design of said nail polish.

6. The method as recited in claim 5, wherein the step of transferring said designed nail polish includes positioning the surface of said fingernail so as to engage the surface of said designed nail polish whereby said designed nail polish adheres to said surface of said fingernail.

7. The method as recited in claim 6, wherein the step of rearranging said nail polish includes the step of touching the tip of an implement to the surface of said suspended nail polish and moving said tip of said implement through said suspended nail polish so as to provide said desired design configuration.

8. The method as recited in claim 7, wherein said liquid transfer medium is formed having a plurality of components that prevents said nail polish suspended thereon from adhering to the surface thereof and allows said nail polish to be freely transferable to said fingernail.

9. The method as recited in claim 8, wherein the components of said transfer medium consist of purified water, hydroxypropylethylcellulose, starch, glyceryl stearate, cellulose acetate, methylparaben, propylparaben quaternium-15, and FD&C Red No. 40.

10. The method as recited in claim 4 including the step of selecting the various colors of said drops.

11. The method as recited in claim 8 including the step of rinsing off of the excess liquid transfer medium.

12. The method as recited in claim 1, including the step of applying a base coat of nail polish on said fingernail prior to transferring said nail polish as designed to said fingernail.

13. The method as recited in claim 12, wherein the base coat is a clear coat.

14. The method as recited in claim 12, wherein the base coat is a selected color coat.

* * * * *